United States Patent [19]

Sasaki et al.

[11] 4,409,929

[45] Oct. 18, 1983

[54] FUEL CONTROL APPARATUS FOR INTERNAL COMBUSTION ENGINE

[75] Inventors: Takeo Sasaki; Yoshinobu Morimoto, both of Himeji, Japan

[73] Assignee: Mitsubishi Denki Kabushiki Kaisha, Tokyo, Japan

[21] Appl. No.: 284,669

[22] Filed: Jul. 20, 1981

Related U.S. Application Data

[63] Continuation of Ser. No. 135,664, Mar. 31, 1980, abandoned.

[30] Foreign Application Priority Data

Mar. 29, 1979 [JP] Japan ..... 54/37811

[51] Int. Cl.[3] ..... F02B 3/00

[52] U.S. Cl. ..... 123/479; 123/494

[58] Field of Search ..... 123/479, 494

[56] References Cited

U.S. PATENT DOCUMENTS

| | | | |
|---|---|---|---|
| 3,722,275 | 3/1973 | Rodely | 123/494 |
| 3,788,285 | 1/1974 | Gelin | 123/494 |
| 3,834,361 | 9/1974 | Keely | 123/479 |
| 3,956,928 | 5/1976 | Barbera | 123/494 |
| 3,967,596 | 7/1976 | Comley | 123/494 |

*Primary Examiner*—Ronald B. Cox

*Attorney, Agent, or Firm*—Oblon, Fisher, Spivak, McClelland & Maier

[57] ABSTRACT

An engine control apparatus equips with an air flow meter for generating a signal having a frequency proportional to an air flow rate for feeding into the engine. A circuit for monitoring an arithmetic and logic unit is equipped to detect a fault of the arithmetic and logic unit thereby switching a control of a fuel feed valve from the control by the arithmetic and logic unit to a monostable multivibrator so as to prevent an inoperability of driving of a car.

6 Claims, 8 Drawing Figures

FUEL CONTROL APPARATUS FOR INTERNAL COMBUSTION ENGINE

This is a continuation of application Ser. No. 135,664, filed Mar. 31, 1980, now abandoned.

BACKGROUND OF THE INVENTION

The present invention relates to an electronic fuel feeder for feeding, into a suction tube of an internal combustion engine, an amount of a fuel corresponding to an air flow rate signal generated by a suction air flow meter provided in the suction pipe. In particular, it relates to an electronic control apparatus for operating an optimum fuel flow rate corresponding to the air flow rate.

Heretofore, such an electronic fuel injection device has been formed of an analogue control system. For example, an air flow meter for measuring the suction air flow rate is an analogue type meter for continuously varying an output voltage corresponding to the suction air flow rate. An analogue electronic circuit (computer) for receiving the output signal then has been used to operate the air flow rate signals and to perform analogue operations on the other analogue input signals for calibration (for example, voltage for coolant temperature or voltage for suction air temperature), thereby deciding the optimum fuel flow rate.

In the electronic circuit having said structure, a fault of an electronic part causes an error in the fuel flow rate. Therefore, remarkably high reliabilities of the electronic parts have been required. Recently, integrated electronic circuits have been remarkably developed. LSI (large scale integrated circuit) has been used in such a fuel control electronic device and the remarkably high reliability of LSI has been required because LSI is used for the important control functions.

Thus, it is difficult to completely eliminate a fault, even if highly reliable LSI is used. It is necessary to provide certain back-up means for overcoming a fault. In the above-mentioned analogue electronic control system, redundant circuits having the same structure have been provided, thereby requiring a remarkably large size of the circuit.

SUMMARY OF THE INVENTION

The present invention is to provide a fuel control apparatus for an internal combustion engine in an electronic control fuel feeding device wherein a fault in a main arithmetic and logic unit produced during controlling of a fuel feed valve is detected by a monitor circuit whereby the control of the fuel feed valve is performed by an output of a monostable multivibrator having a simple structure thereby preventing an inoperability of driving of a car.

DETAILED DESCRIPTION OF THE PREFERRED EMBODIMENTS

The fuel control apparatus for an internal combustion engine of the present invention is nextly described in detail.

Figure 1:
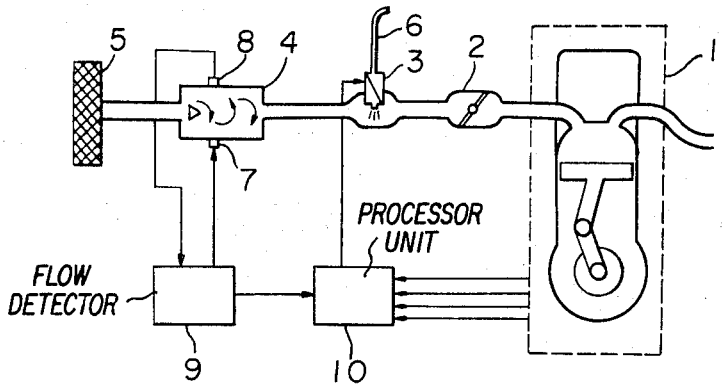
FIG. 1 is a system diagram of one embodiment of the present invention.

FIG. 1 shows a system diagram of the fuel feed system according to the present invention. In FIG. 1, the reference numeral (1) designates an engine; (2) designates a throttle value for controlling a suction air rate; (3) designates an electromagnetic fuel feed valve which opens for a specific time to inject fuel into a suction tube; (4) designates an air flow meter for measuring the suction air flow rate, which is Karman vortex meter; (5) designates an air cleaner; (6) designates a fuel pipe; (7) designates an ultrasonic oscillator; (8) designates an ultrasonic receiver to monitor the Karman vortex which is internally formed in the air flow meter (4); (9) designates a flow detector which detects the Karman vortex by comparing the output phase of the ultrasonic oscillator (7) with the receiving phase of the ultrasonic receiver (8) thereby to generate a signal having frequency proportional to the air flow rate per hour in the suction tube; (10) designates a digital electronic processor unit which drives the fuel feed valve (3) depending upon the output frequency of the flow detector (9) and which calibrates a fuel flow rate depending upon various conditions of the engine (coolant temperature, suction air temperature, revolutions per minute, and the degree of throttle opening).

Figure 2:
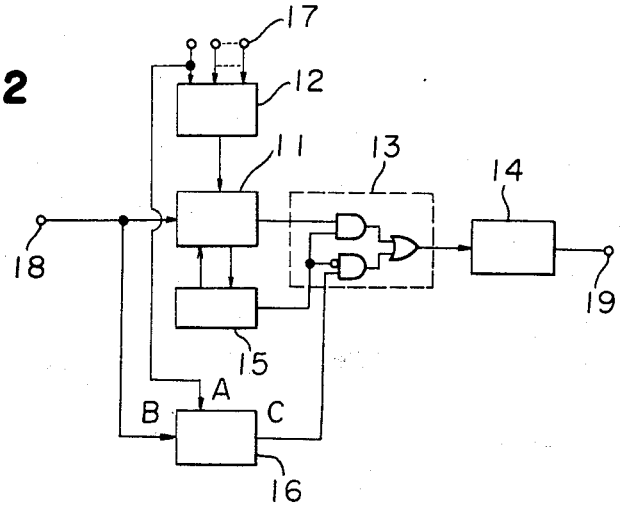
FIG. 2 is a block diagram of a control apparatus of the present invention.

FIG. 2 shows an internal block diagram of the processor unit (10). In FIG. 2, the reference numeral (11) designates a LSI central processor (microprocessor) which decides the timing for driving the fuel feed valve (3) depending upon the output period of the flow detector and detects a pulse length depending upon various conditions of the engine; (12) designates an A/D converter for converting analogue inputs into digital signals; (13) designates a selective circuit; (14) designates a driving unit for driving the fuel feed valve (3); (15) designates a monitor circuit for detecting a fault in the central processor; (16) designates a monostable multivibrator which is tiggered by the output of the flow detector (9); (17) designates an analogue input terminal; (18) designates a flow rate signal terminal; and (19) designates a fuel feed valve driving terminal.

Figure 3:
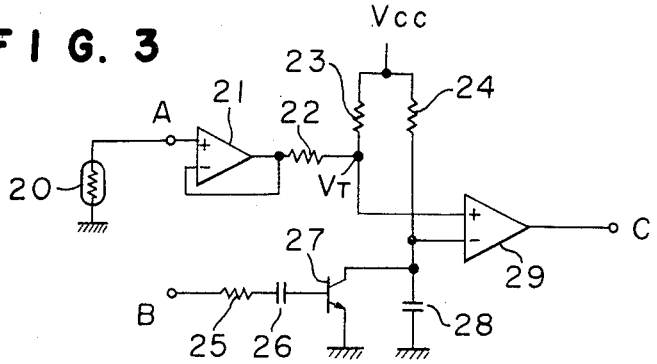
FIG. 3 is a circuit diagram of a monostable multivibrator used in the present invention.

FIG. 3 shows a structure of the monostable multivibrator (16) shown in FIG. 2. In FIG. 3, the reference numeral (20) designates a thermistor for detecting a temperatures of the coolant; (21) designates a buffer-amplifier; (22) to (25) designate resistors; (26), and (28) designate capacitors; (27) designates a transistor; (29) designates a comparator connected to an RC charging circuit formed by the resistor (24) and the capacitor (28) while is periodically discharged (28) through the transistor (27). The resistor (25) and the capacitor (26) forms a differentiation circuit wherein the transistor (27) enters the ON state for a short time at each leading point edge of the input waveform fed from the terminal B. The output of the buffer-amplifier (21) is varied depending upon the temperature of the temperature of the coolant in the engine. When the temperature of the coolant is lower, a high voltage is applied. When it is higher, a low voltage is applied. The output of the buffer-amplifier (21) is shunted by the resistors (23), (24) and applied as a comparison potential [$V_T$] to the comparator (29). As a result, the comparator output (C) includes pulses each having a pulse length depending upon the temperature of the coolant for each leading edge of the pulse signals applied at the (B) input terminal.

Figure 4:
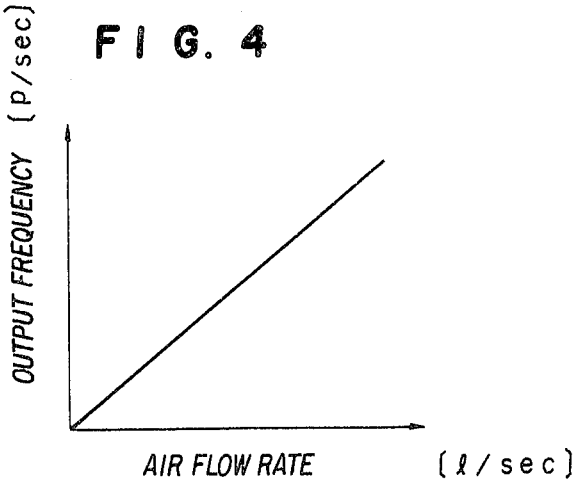
FIG. 4 is an output characteristic curve of a flow detector used in the present invention.

FIG. 4 shows a characteristic curve of an output of the flow detector (9) which indicates that the frequency is varied in proportion to the air flow rate of air fed into the engine.

Figure 5:
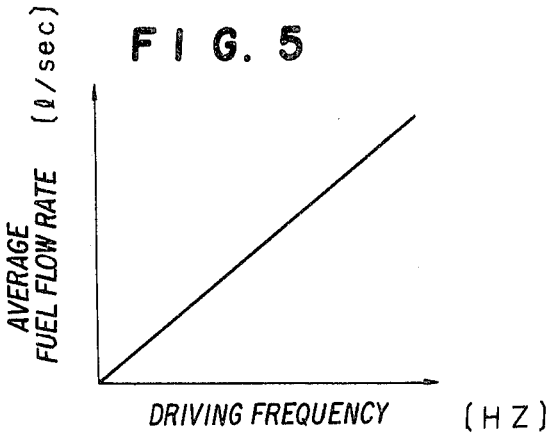
FIG. 5 is a characteristic curve of the frequency for driving a fuel feed valve versus the average fuel flow rate according to the present invention.

FIG. 5 shows the relationship of the frequency for driving the fuel feed valve at the output of the processor unit (10) relative to the fuel flow rate of the fuel injected into the suction tube. When the injection pulse length for one time is constant, they are in proportional relation.

Figure 6:
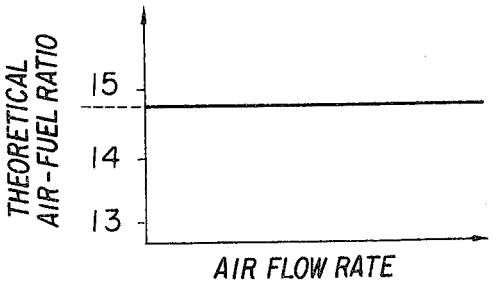
FIG. 6 is a characteristic curve of the flow rate versus the ratio of air to fuel according to the present invention.

FIG. 6 shows a graph of the air flow rate relative to the air-fuel ratio in the engine.

Figure 7:
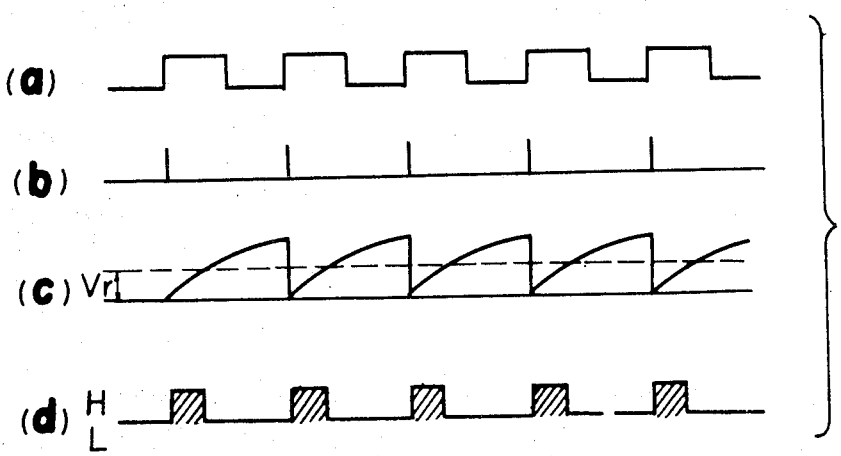
FIG. 7 shows timing charts according to the present invention.

FIG. 7 shows timing charts showing operations of parts of the monostable multivibrator shown in FIG. 3. FIG. 7(*a*) is the input waveform at (B) terminal; FIG. 7(*b*) is the waveform at the base of the transistor (27); and FIG. 7(*c*) is the voltage waveform across the capacitor (28); and FIG. 7(*d*) is an output waveform of the comparator (29).

Figure 8:
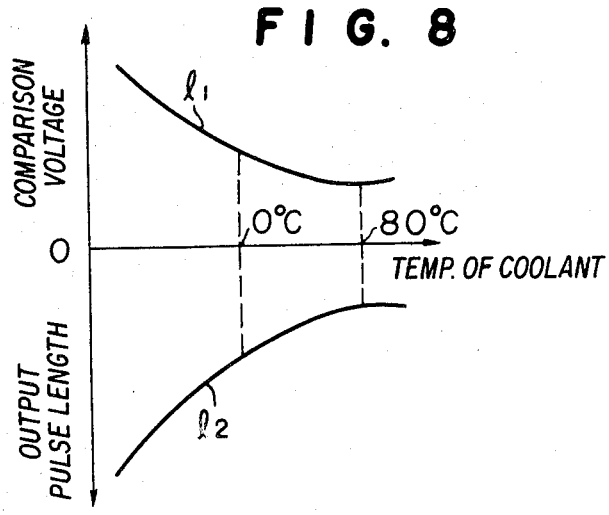
FIG. 8 is a characteristic curve of the temperature of a coolant versus the output pulse length according to the present invention.

FIG. 8 shows the relation of the temperature of the coolant and the comparison voltage [$V_T$] and the output pulse length in the embodiment of FIG. 3.

The operation in the normal state of the above described embodiment is nextly explained.

In the system of FIG. 1, the flow detector (9) compares signal phases of the oscillator (7) and the receiver (8) so as to detect the condition of the vortex formed in the Karman vortex meter (4). It has been known that the period for forming the Karman vortex is proportional to the flow rate. When the sectional area of the passage is constant, the frequency of the vortex is proportional to the air flow rate. The flow detector (9) obtains the frequency signal proportional to the air flow rate by monitoring the Karman vortex by the ultrasonic transmitter-receiver. This is shown in FIG. 4.

In order to drive the engine under optimum conditions, it is necessary to maintain a constant ratio of the suction air flow rate to the fuel flow rate which is usually 14.8 by weight (this is referred to as a theoretical air-fuel ratio). In order to provide such condition, a pulse train having a constant pulse length is generated at a frequency proportional to the output frequency of the flow detector (9) and the fuel feed valve (3) is driven depending upon the pulse train. This operation is controlled by the central processor (11) shown in FIG. 2, which generates a driving frequency proportional to the input frequency of the flow rate signal applied to the input terminal (18) as shown in FIG. 3 and the pulse length is constant. As a result, the average fuel flow rate injected through the fuel feed valve (3) is proportional to the air flow rate. The air-fuel ratio in the cylinder of the engine is always constant regardless of the air flow rate as shown in FIG. 6.

In order to drive the engine stably at the starting or just after the starting of the engine, it is necessary to increase the fuel flow rate relative to the theoretical air-fuel ratio. The calibration thereof is also performed by the central processor (11) in FIG. 2. The data for the temperature of the coolant, the suction air temperature and the throttle degree of opening are input as analogue voltages through analogue input terminal (17). The A/D converter converts the data into digital data and transmit the digital data to the central processor (11) wherein the reference pulse lengths are adjusted depending upon the data to transmit the pulse having the final pulse lengths to the terminal (19). As a result, a mixed gas having the optimum air-fuel ratio for the condition of the engine is fed into the engine to perform the stable driving.

The monitor circuit (15) monitors the operation of the central processor (11). When the central processor (11) is in the normal state, the "H" signal is transmitted to the selective circuit (13) and the output of the central processor (11) is used for the pulse input into the driving device (14). When a fault condition is detected, the "L" signal is transmitted and the output of the monostable multivibrator (16) is input into the driving device (14).

As one embodiment of the monitor circuit, a Watchdog timer can be used. During the normal operation of the central processor (11), "H" signal and "L" signal are alternately transmitted to the monitor circuit for each constant period. The monitor circuit monitors only this normal condition.

When a fault occurs, the signal is stopped at the "H" or "L" level. Thus, if the "H" or "L" level continues for longer than the predetermined period, there considered to be a fault in the central processor (11). When the central processor (11) is a microcomputor, access programs for the monitor circuit are inserted at various parts of the processing program, the "H" signal and "L" signal are alternately transmitted to the monitor circuit in the normal order of the program. When an abnormal condition of the central processor (11) is detected by the monitor circuit, an opposite polarity switching signal is transmitted to the selective circuit (13). If necessary, a restart signal can be transmitted to the central processor (11). When the central processor is formed by a microprocessor, and an abnormal progress of the program is found, a reset signal is applied. When any abnormal condition is not found in H/W, the microprocessor is reset to the normal state.

The operation of the central processor (11) in the abnormal state will be described.

In the embodiment of FIG. 2, the signal from the flow rate signal input terminal (18) is also transmitted to the monostable multivibrator (16) which transmits a signal having a predetermined pulse length at each leading point of the input pulse.

Referring to FIGS. 3, 7 and 8, the operation is nextly described.

In FIG. 3, a thermister for detecting the temperature of the coolant for the engine is connected at the part A as shown.

A bias circuit (not shown) controls the voltage at the part A to be high in the case of low coolant temperature or be low in the case of high temperature of the coolant. The voltage is received by the buffer-amplifier (21) and shunted by the resistors (22),(23) to form the comparison voltage [$V_T$]. The curve of FIG. 8 ($l_1$) shows the variation in the comparison voltage [$V_T$] depending upon the temperature of the coolant.

On the other hand, the signal fed into the terminal (B) turns on the transistor (27) for a short time at each leading edge of the signal by means of the differentiation circuit comprising the resistor (25) and the capacitor (26). As a result, the charge in the capacitor (28) is discharged through the collector and emitter of the transistor (27) and the capacitor (28) is charged again through the resistor (24) after turning off the transistor (27). FIG. 7 shows this condition. FIG. 7(*a*) shows the air flow rate signal waveform at the terminal (B); FIG. 7(*b*) shows the waveform at the base of the transistor (27); FIG. 7(*c*) shows the voltage waveform across the capacitor (28); FIG. 7(*d*) shows the output waveform of the comparator (29). When the temperature of the coolant is varied, the comparison voltage [$V_T$] applied to the comparator (29) is varied and the comparator output pulse length is also varied as shown in FIG. 7 depending upon the temperature of the coolant as shown in FIG. 8 ($l_2$), and the engine drives in the stable condition.

At the starting of the engine, sometimes, it is difficult to start the engine at an increased fuel rate due to the temperature of the coolant. In such condition, it is possible to feed the data for the starting into the monostable multivibrator so as further increase the ratio of the fuel. In accordance with this feature, even though a fault the central processor is present, the starting and the warming-up of the engine can be performed in substantially the same manner as that of the normal driving.

The Karman vortex air flow meter described in the embodiment utilizes a phenomenon such that when a cylinder or a triangle prism is placed in the passage of the fluid as shown in FIG. 1 (4), the frequency for forming vortexes behind the cylinder (prism) is proportional to the flow rate of the fluid. If the ultrasonic wave is fed to the Karman vortex forming part, the ultrasonic wave causes certain phase deviation by the vortex. Therefore, the Karman vortex being proportional to the flow rate can be detected by returning the phase deviation by the flow detector (9).

In the embodiment, a microcomputer is used as the central processor (11). The functions performed by the digital computor can be determined by selecting a program. Therefore, it has been advantageous to utilize the digital computor for the control of the car from the viewpoints of a short developing time, an easy modification, an improvement of reliability and low cost of the elements. Thus, it is absolutely not allowable to permit a debilitating fault fault in a device for controlling the basic functioning of the car such as the control of the engine. High reliability is required. Even though a fault occurs, it is necessary to provide a back-up means for driving the car to a factory for its repair, by itself.

What is claimed is:

1. A fuel control apparatus for an internal combustion engine, comprising:

an air flow detector which generates a pulse signal having a frequency proportional to an air flow rate of air fed into said engine;

a fuel feed valve which is placed in a suction air passage of said engine to feed a fuel into a suction tube by its switching operation;

a processor unit which controls the operation period of said fuel feed valve to open said valve for a predetermined period depending upon the output frequency of the pulse signal produced by said air flow detector and which varies the operation period of said valve depending upon predetermined conditions of said engine;

a monitor means for detecting a fault condition in said processor;

a monostable multivibrator unit including means for producing a signal related to engine coolant temperatures, which produces a pulse signal having a frequency depending upon the output frequency of said air flow detector and a pulse width depending upon the engine coolant temperature;

a selective means controlled by the monitor means for selecting the output pulse signal of said processor when no processor fault is detected and for selecting the pulse signal output of said monostable multivibrator unit when a processor fault is detected; and a driving means having an input coupled to the selective means for driving said fuel feed valve with the output pulse signal selected by said selective means;

wherein said monostable multivibrator unit comprises:

a comparator;

temperature sensing means for producing a voltage related to engine coolant temperature and for applying said voltage to a first input of said comparator;

an RC charging circuit including a resistor and capacitor connected in series at a junction also connected to a second input of said comparator; and differentiation circuit means having an input coupled to the pulse signal produced by said air flow detector for temporarily discharging said capacitor upon each occurrence of said air flow detector pulse signal;

wherein said comparator produces the output pulse signal of said monostable multivibrator unit with a pulse width based on the amount of time taken for the voltage of said capacitor to exceed the voltage produced by said temperature sensing means after discharge of said capacitor by said differentiation circuit means.

2. A fuel control apparatus for an internal combustion engine, which comprises:

an air flow detector which generates a pulse signal having a frequency proportional to an air flow rate of air fed into said engine;

a fuel feed valve which is placed in a suction air passage of said engine to feed a fuel into a suction tube by its switching operation;

a processor unit which controls the operation period of said fuel feed valve to open said valve for a predetermined period depending upon the output frequency of the pulse signal produced by said air flow detector and which varies the operation period of said valve depending upon predetermined conditions of said engine;

a monitor means for detecting a fault condition in said processor;

a monostable multivibrator unit including means for producing a signal related to engine coolant temperatures, which produces a pulse signal having a frequency depending upon the output frequency of said air flow detector and a pulse width depending upon the engine coolant temperature;

a selective means controlled by the monitor means for selecting the output pulse signal of said processor when no processor fault is detected and for selecting the pulse signal output of said monostable multivibrator unit when a processor fault is detected; and a driving means having an input coupled to the selective means for driving said fuel feed valve with the output pulse signal selected by said selective means;

wherein said processor unit alternately transmits an "H" signal and a "L" signal to said monitor means in each periodic interval during fault-free processor operation; and wherein said monitor means detects the period of the "H" signal or the "L" signal and determines the occurrence of a processor fault based on the detected period.

3. A fuel control apparatus according to claim 1 wherein said monitor means transmits an "H" signal to said selective means during fault-free processor operation and transmits an "L" signal to said selective means during a processor fault condition and either the output pulse signal of said processor unit or the output pulse signal of said monostable multivibrator unit is transmitted to said driving means depending upon transmission of said "H" signal or said "L" signal.

4. A fuel control apparatus according to claim 2 wherein said processor unit is a computer and an access program for said monitor means are inserted into a process program of said microcomputer.

5. A fuel control apparatus according to claim 1 wherein said processor unit is a digital computer.

6. A fuel control apparatus according to claim 1 wherein said air flow detector is formed by placing a rod in a passage of a fluid to form Karman vortex behind said rod and an ultrasonic wave is transmitted to said Karman vortex to detect an air flow rate by a phase deviation caused by the vortex of the ultrasonic wave.

* * * * *